United States Patent [19]

Karol

[11] Patent Number: 5,062,863

[45] Date of Patent: Nov. 5, 1991

[54] FUEL COMPOSITIONS CONTAINING POLYALKYLATED 1,3,4-THIADIAZOLES

[75] Inventor: Thomas J. Karol, Norwalk, Conn.

[73] Assignee: R. T. Vanderbilt Company, Inc., Norwalk, Conn.

[21] Appl. No.: 524,538

[22] Filed: May 17, 1990

[51] Int. Cl.[5] ..... C10L 5/00

[52] U.S. Cl. ..... 44/341; 548/141; 548/142

[58] Field of Search ..... 44/341; 548/141, 142

[56] References Cited

U.S. PATENT DOCUMENTS

| | | | |
|---|---|---|---|
| 2,719,125 | 9/1955 | Roberts | 252/46.7 |
| 2,719,126 | 9/1955 | Fields et al. | 252/47 |
| 2,850,453 | 9/1958 | Fields | 252/32.7 |
| 4,432,847 | 2/1984 | Fields | 204/158 R |
| 4,790,948 | 12/1988 | Liu et al. | 252/47.5 |
| 4,904,403 | 2/1990 | Karol | 252/47.5 |
| 4,964,880 | 10/1990 | Schilowitz et al. | 44/341 |

*Primary Examiner*—Prince Willis, Jr.
*Assistant Examiner*—R. D. Flatter
*Attorney, Agent, or Firm*—Rasma B. Balodis

[57] ABSTRACT

A diesel fuel composition comprising a major portion of middle distillates and a minor wear improving amount of a 1,3,4-thiadiazole derived from 2,5-dimercapto-1,3,4-thiadiazole and one or two moles of polyolefin having 50 to 400 carbon atoms. Furthermore, the 5-position of the 2-mercapto-1,3,4-thiadiazole may be substituted by alkylthio, 2-hydroxyalkylthio, amino or hydroxy group. The 1,3,4-thiadiazole compounds are also effective dispersants when incorporated into fuel compositions.

5 Claims, No Drawings

FUEL COMPOSITIONS CONTAINING POLYALKYLATED 1,3,4-THIADIAZOLES

BACKGROUND OF THE INVENTION

The present invention concerns improved fuel compositions. More particularly, it relates to diesel fuel composition having improved wear resistance.

Internal combustion engines, particularly diesel engines are susceptible to wear in the upper cylinder region. It is believed that the majority of wear occurring in the upper cylinder is caused by the upward motion of the piston. While lubricating oils prevent wear on the downward stroke, the lubricating oil has no contact with the cylinder wall on the upward motion. During the upward compression stroke only the fuel is in contact with the cylinder wall and can influence its wear.

Accordingly, it is an object of the invention to provide diesel fuel having improved antiwear properties.

It is known that polyalkylated 1,3,4-thiadiazole compounds impart antioxidant and antiwear properties to lubricating oils as described in U.S. Pat. No. 4,904,403. Lower chain alkyl derivatives of 2,5-disulfinyl-1,3,4-thiadiazoles have been disclosed as surfactants in U.S. Pat. No. 4,432,847.

It has been now discovered that certain polyalkylated 1,3,4-thiadiazoles impart antiwear properties to diesel fuel and function as detergents or dispersants therein.

SUMMARY OF THE INVENTION

In accordance with the invention, there are provided diesel fuel compositions having improved antiwear properties and comprising a major portion of a diesel fuel and a minor wear resistance imparting portion of a polyalkylated 1,3,4-thiadiazole selected from the group of compounds having the structural formula

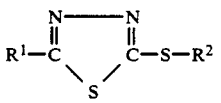

(I)

wherein $R^1$ represents hydroxy, amino, mercapto, alkylthio, 2-hydroxyalkylthio or $R^2$ S- group and $R^2$ represents a polyolefin residue and is characterized by the formulae

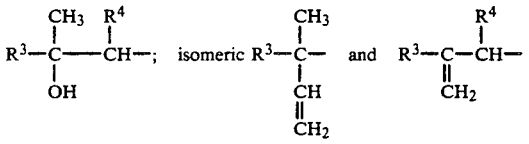

wherein $R^3$ is an alkyl group having 50 to 400 carbon atoms and $R^4$ is hydrogen or methyl group.

DESCRIPTION OF SPECIFIC EMBODIMENTS

The polyalkylated 1,3,4-thiadiazole additives of the invention may be prepared by reacting 2,5-dimercapto-1,3,4-thiadiazole with one or two molar equivalents of a polyolefin having an epoxidized or chlorinated end unit.

The general reaction scheme is illustrated by the following equation wherein R represents a polyolefin residue.

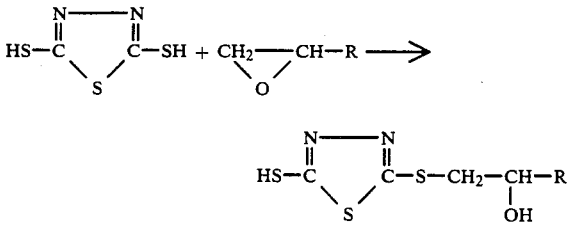

Preferably, the reaction is conducted in the presence of an inert solvent such as alcohols, toluene and acetone. The reaction temperature will depend upon the specific reactants and solvent media employed. Typically, reaction temperatures range from about −5° C. to 60° C.

The chlorinated polymer starting material is typically an isomeric mixture. Therefore, a chlorine displacement causing a bond shift will occur with the formation of two isomers.

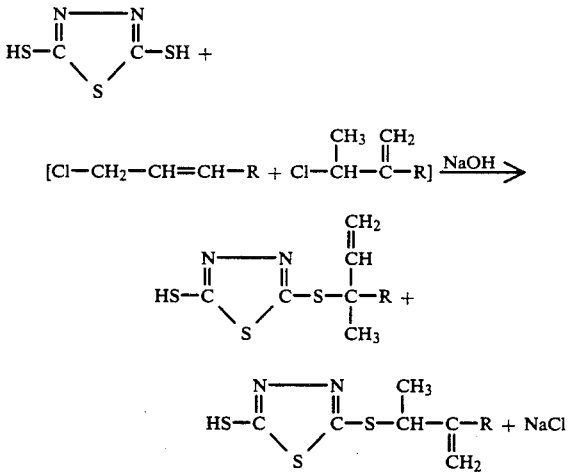

The amino derivatives of the invention may be prepared from commercially available 2-amino-5-mercapto-1,3,4-thiadiazole precursor by similar reaction schemes. The hydroxy derivatives may be prepared by reacting the mercapto group with propylene oxide followed by sodium hydroxide treatment. Some hydrocarbon substitution may occur on the nitrogen and oxygen atom. Furthermore, in all described monohydrocarbyl substitution reactions some dihydrocarbyl substituted derivatives may form as by-products.

The polyolefin starting material is a hydrocarbon polymer with an epoxide or chlorine functionality at one end. The polymeric chain contains at least 50 carbon atoms and may range to about 400 carbon atoms. Typically, the molecular weight of the polyolefin ranges from 100 to 5000 and higher. The polymers are prepared by copolymerizing olefins as for example ethylene, propylene and butylene. Preferred are polymers containing tertiary alkyl units having about 50 to 200 carbon atoms. Especially useful are polymers of alpha-olefins as for example isopropene, isobutene, 2-methyl-1-heptene, and 2-methyl-5-propylhexene.

Activated polyolefins are available commercially. For example, activated polyisobutenes with epoxide functionality are marketed under the trade name ACTIPOL TM by Amoco Chemical Company. Alternately, commercial polyolefins may be epoxidized by known methods.

The polyalkylated 1,3,4-thiadiazoles of the invention may be added to diesel fuel in an effective amount to impart antiwear properties. The effective amount may range from about 0.01 to 5.0 percent. The constant, repeated injection of the fuel in the cylinder may cause a cumulative effect of the additive on the surface of the metal wall. Because of this cumulative effect, relatively small amounts of the additive may be required to afford antiwear protection in practical application. The economically preferred amount may range from about 0.01 to 1.0 percent.

Diesel fuels are petroleum refinery products commonly known as middle distillates. These fuels are complex mixtures of many different hydrocarbons. The properties of commercial diesel fuels depend on the refining process and the nature of the crude oil from which it is derived. Generally, the boiling range of the fuels is between 163° C. to 400° C. and the kinematic viscosity at 40° C. ranges between 1.3 to 24.0 cSt.

The preferred diesel fuels are fuel oils complying with ASTM specifications compiled in Table I.

TABLE I

Specifications for Diesel Fuel Oils, ASTM D975-78

| Property | Grade 1-D | 2-D | 4-D |
|---|---|---|---|
| Distillation (90%) point, °C. | 288 max. | 282–383 | — |
| Flash point, °C. | 38 | 52 | 55 |
| Viscosity at 40° C., kinematic, mm $^2$/s (= cSt) | 1.3–2.4 | 1.9–4.1 | 5.5–24.0 |
| Cetane number, min. | 40 | 40 | 40 |

The properties of the fuel affect directly the power, economy, performance and wear of the engine. In addition to the wear inhibiting additive, diesel fuels may contain other additives to enhance their properties. These additives may be ignition quality improvers, oxidation inhibitors, biocides, rust preventives, metal deactivators, pour point depressors, emulsifiers, smoke suppressants and other dispersants.

The following examples are given for the purpose of further illustrating the invention. All percentages and parts are based on weight unless otherwise indicated.

EXAMPLE 1

2,5-Dimercapto-1,3,4-thiadiazole (hereinafter DMTD) (159 g, 1.06 mol), methylene chloride (1000 ml), and acetone (1000 ml) were charged to a reaction vessel. Epoxidized polyisobutylene with an average molecular weight of 973 (1031.4 g, 1.06 mol) was added with stirring. The reaction mixture was allowed to react overnight with stirring and for 24 hours thereafter without stirring. The solvent was stripped off on a rotary evaporator under a reduced pressure. Pentane (500 ml) was added to precipitate unreacted DMTD. The filtered product contained 67–78 percent active ingredient, i.e. DMTD reaction product.

EXAMPLE 2

Epoxide polyisobutylene with average molecular weight of 365 (373 g, 1.02 mol) and isopropanol (500 ml) were charged into a reaction vessel and DMTD (125 g, 0.813 mol) was added with stirring. After stirring the reaction mixture for 48 hours at room temperature, isopropanol solvent was stripped off under reduced pressure on a rotary evaporator and the product was diluted with hexane (250 ml) and filtered to remove unreacted DMTD. Hexane was stripped off as the previous solvent. The yield was 80.3 percent of active product.

EXAMPLE 3

The additives of the invention were evaluated by the Shell Four-Ball Wear Test.

The test was conducted essentially according to the method described in ASTM D-2266 procedure. Four lightly polished steel balls 12.5 mm in diameter were placed in a test cup and submerged in the test sample. The test fuel was D-2 diesel fuel manufactured by Texaco, Inc. The test was carried out at a rotation speed of 1800 rpm under a load of 40 kg for one hour at 93.3° C.

The additives of the invention were added to the fuel oil in the amount indicated in Table II. Fuel compositions containing the present additives show improved antiwear properties.

TABLE II

Four-Ball Wear Test

| Sample | Active Ingredient | Percent | Scar, mm |
|---|---|---|---|
| 1 | None | — | 1.56 |
| 2 | Compound of Example 1 | 5.00 | 0.82 |
| 3 | Compound of Example 2 | 0.67 | 0.82 |

The above embodiments have shown various aspects of the present invention. Other variations will be evident to those skilled in the art and such modifications are intended to be within the scope of the invention as defined by the appended claims.

What is claimed is:

1. A diesel fuel composition characterized by improved wear properties and comprising a major portion of middle distillates boiling in the range of about 163° C. to 400° C. and a minor wear improving amount of a polyalkylated 1,3,4-thiadiazole selected from the group of compounds having the structural formula

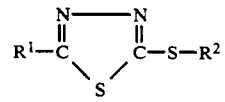

wherein $R^1$ represents hydroxy, amino, mercapto, alkylthio, 2-hydroxyalkylthio or $R^2S$- group and $R^2$ represents a polyolefin residue and is characterized by the formulae

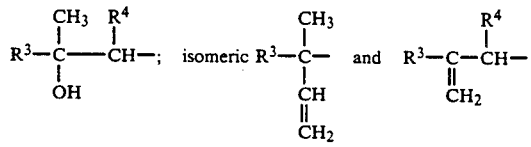

wherein $R^3$ is an alkyl group having 50 to 400 carbon atoms and $R^4$ is hydrogen or methyl group.

2. The fuel composition of claim 1 wherein the 1,3,4-thiadiazole is present in the amount ranging from 0.01 to 5.0 percent by weight based on the weight of the fuel composition.

3. The fuel composition of claim 1 wherein the polyolefin residue is derived from epoxidized polyolefin having 50 to 200 carbon atoms.

4. The fuel composition of claim 1 wherein the polyolefin residue is derived from chlorinated polyolefin having 50 to 200 carbon atoms.

5. A method of improving the wear resistance of a diesel fuel which comprises adding to diesel fuel about 0.01 to 5.0 percent of a 1,3,4-thiadiazole selected from the group of compounds having the structural formula

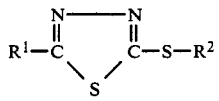

wherein $R^1$ represents hydroxy, amino, mercapto, alkylthio, 2-hydroxyalkylthio or $R^2S$- group and $R^2$ represents a polyolefin residue and is characterized by the formulae

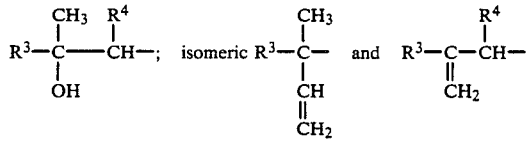

wherein $R^3$ is an alkyl group having 50 to 400 carbon atoms and $R^4$ is hydrogen or methyl group.

* * * * *